US009101257B2

(12) United States Patent
Boyer

(10) Patent No.: US 9,101,257 B2
(45) Date of Patent: Aug. 11, 2015

(54) APPLIANCE WITH AN INSET BASE ELEMENT

(75) Inventor: Joel Charles Boyer, Louisville, KY (US)

(73) Assignee: General Electric Company, Schenectady, NY (US)

( * ) Notice: Subject to any disclaimer, the term of this patent is extended or adjusted under 35 U.S.C. 154(b) by 883 days.

(21) Appl. No.: 13/348,713

(22) Filed: Jan. 12, 2012

(65) Prior Publication Data

US 2013/0180556 A1 Jul. 18, 2013

(51) Int. Cl.
*A47L 15/42* (2006.01)

(52) U.S. Cl.
CPC ..... *A47L 15/4253* (2013.01)

(58) Field of Classification Search
None
See application file for complete search history.

(56) References Cited

U.S. PATENT DOCUMENTS 6,427,966 B1 * 8/2002 Blumenschein ..... 248/678
7,748,682 B2 * 7/2010 Hunke et al. ..... 248/678

FOREIGN PATENT DOCUMENTS

JP 7265241 A 10/1995

* cited by examiner

*Primary Examiner* — Jason Ko
(74) *Attorney, Agent, or Firm* — Dority & Manning, P.A.

(57) ABSTRACT

The present subject matter provides a base element for an appliance. The base element includes a projected portion and an inset portion. The inset portion has a different height than the projected portion such that the inset portion is configured for receipt of flooring.

16 Claims, 3 Drawing Sheets

APPLIANCE WITH AN INSET BASE ELEMENT

FIELD OF THE INVENTION

The present subject matter relates generally to base elements for appliances.

BACKGROUND OF THE INVENTION

Conventionally, dishwasher appliances include a cabinet supported by a base element. The base element projects downwardly from a bottom of the cabinet and rests on flooring beneath the cabinet. The base element can also include leveling assemblies (e.g., screws) that may be selectively adjusted in order to level the cabinet. By leveling the cabinet, e.g., the appliance's appearance within cabinetry can be improved.

Generally, dishwasher appliances are installed beneath a countertop. During installation, the appliances' cabinet slides beneath the countertop. The cabinet's base element slides along a kitchen's flooring until the cabinet is disposed beneath the countertop. However, the kitchen's flooring can change over time or have height differences between the flooring and a subfloor. For example, hardwood flooring can be installed, and such hardwood flooring can raise the height of the kitchen's flooring or subfloor. For example, hardwood flooring can be about an inch thick and can be installed over existing flooring. Thus, in such example, the overall height of the kitchen's flooring can be raised by about an inch.

Dishwasher appliances generally have a minimum height requirement for countertop enclosures housing the appliance's cabinet. Thus, installing hardwood flooring beneath the appliance can cause the cabinet to not fit within the countertop enclosure. To permit the appliance's cabinet to fit within the countertop enclosure, hardwood flooring can be terminated prior to the countertop housing the appliance such that the appliance's base element remains resting on the kitchen's original flooring in the front and a subfloor in the back. However, this solution can create its own problems. For example, to remove the appliance, the base element can slide along the original flooring until it encounters the newer hardwood flooring. When the base element hits the hardwood flooring, a consumer can face significant difficulty in removing the appliance from its countertop enclosure.

Accordingly, a dishwasher appliance with features for assisting in installing and/or removing the appliance from a countertop enclosure with a different flooring height compared to a kitchen flooring height would be useful.

BRIEF DESCRIPTION OF THE INVENTION

Aspects and advantages of the invention will be set forth in part in the following description, or may be obvious from the description, or may be learned through practice of the invention.

In a first embodiment, an appliance is provided that includes a cabinet having a top portion and a bottom portion. A base element is positioned adjacent the bottom portion of the cabinet. The base element extends downwardly from the cabinet in order to support the cabinet. The base element also extends from a first end to a second end. The first end of the base element is positioned adjacent a back of the cabinet and the second end of the base element is positioned adjacent a front of the cabinet. The base element includes a projected portion positioned adjacent the first end of the base element. The projected portion has a first height. The base element also includes an inset portion positioned adjacent the second end of the base element. The inset portion has a second height. The second height is greater than the first height.

In a second embodiment, an appliance is provided that includes a cabinet with a bottom portion and a top portion. A base element is positioned adjacent the bottom portion of the cabinet and configured for supporting the cabinet. The base element includes a leg projecting downwardly from the cabinet and positioned adjacent a back of the cabinet. The leg has a proximal end and a distal end. The proximal end is positioned adjacent the cabinet. An elongated member extends from the distal end of the leg towards a front of the cabinet. The elongated member has an inset portion positioned adjacent the front of the cabinet and a projected portion positioned adjacent the back of the cabinet. The inset portion is positioned closer to the cabinet than the projected portion.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
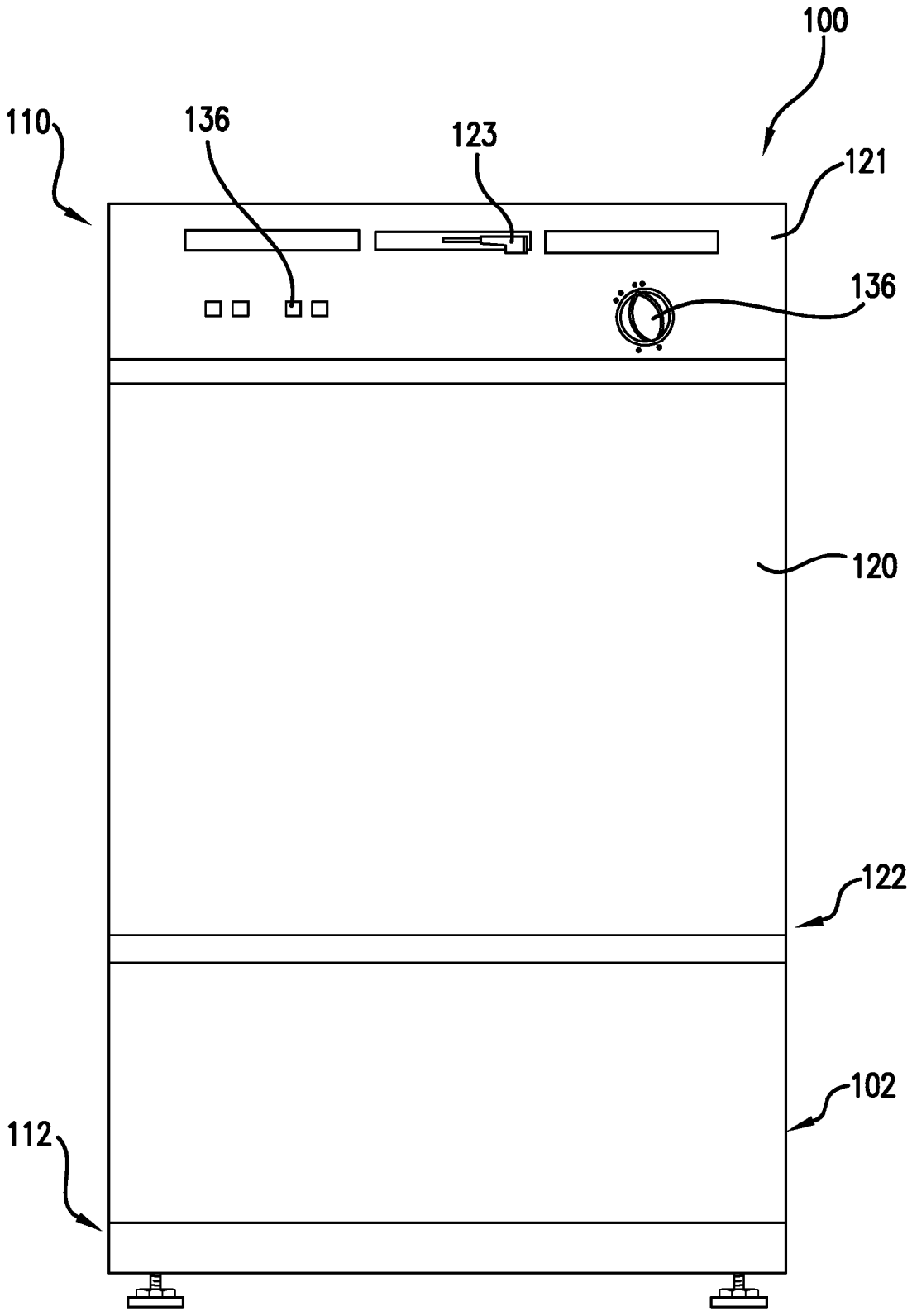
FIG. 1 provides a front view of a dishwasher appliance according to an exemplary embodiment of the present subject matter.

The present subject matter provides a base element for an appliance. The base element includes a projected portion and an inset portion. The inset portion has a different height than the projected portion such that the inset portion is configured for receipt of flooring. Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
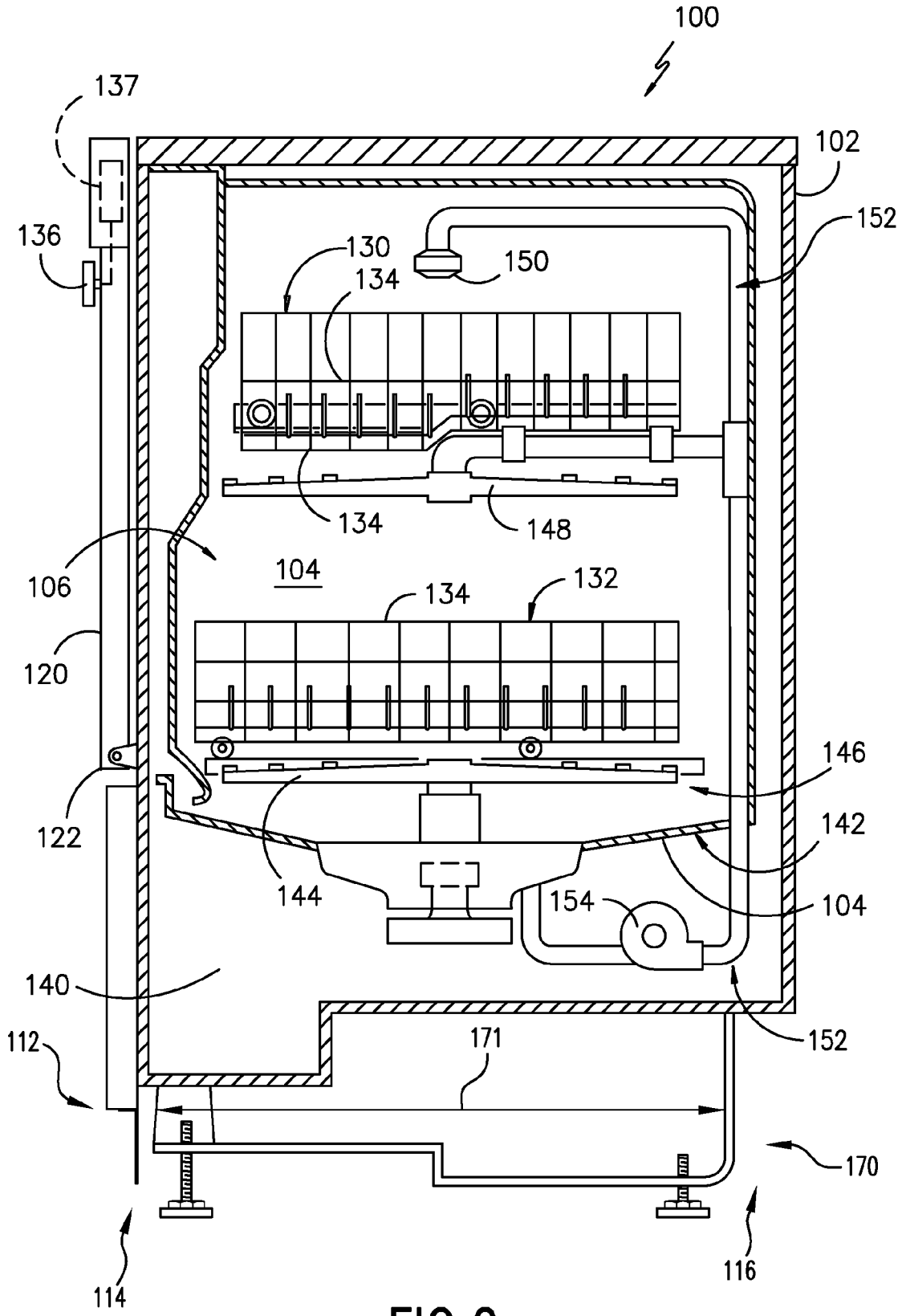
FIG. 2 provides a side cross-sectional view of the dishwasher appliance of FIG. 1, particularly illustrating a wash chamber of the dishwasher appliance.

FIGS. 1 and 2 depict an exemplary domestic dishwasher appliance 100 that may be configured in accordance with aspects of the present disclosure. For the particular embodiment of FIG. 1, the dishwasher 100 includes a cabinet 102 that extends between a front 114 and a back 116. The cabinet 102 also extends between a top 110 and a bottom 112. As discussed in greater detail below, a base element 170 extends (e.g., downwardly) from the bottom 112 of cabinet 102 in order to support cabinet 102. The cabinet 102 also has a tub 104 therein that defines a wash chamber 106. The tub 104 includes a front opening (not shown) and a door 120 hinged at its bottom 122 for movement between a normally closed, vertical position (shown in FIGS. 1 and 2), wherein the wash chamber 106 is sealed shut for washing operation, and a horizontal, open position for loading and unloading of articles from the dishwasher. Latch 123 is used to lock and unlock door 120 for access to chamber 106.

Rack assemblies 130 and 132 are slidably mounted within the wash chamber 106. Each of the rack assemblies 130, 132 is fabricated into lattice structures including a plurality of elongated members 134. Each rack 130, 132 is adapted for movement between an extended loading position (not shown) in which the rack is substantially positioned outside the wash chamber 106, and a retracted position (shown in FIGS. 1 and 2) in which the rack is located inside the wash chamber 106. A silverware basket (not shown) may be removably attached to rack assembly 132 for placement of silverware, utensils, and the like, that are otherwise too small to be accommodated by the racks 130, 132.

The dishwasher 100 further includes a lower spray-arm assembly 144 that is rotatably mounted within a lower region 146 of the wash chamber 106 and above a tub sump portion 142 so as to rotate in relatively close proximity to rack assembly 132. A mid-level spray-arm assembly 148 is located in an upper region of the wash chamber 106 and may be located in close proximity to upper rack 130. Additionally, an upper spray assembly 150 may be located above the upper rack 130.

The lower and mid-level spray-arm assemblies 144, 148 and the upper spray assembly 150 are fed by a fluid circulation assembly 152 for circulating water and dishwasher fluid in the tub 104. The fluid circulation assembly 152 may include a pump 154 located in a machinery compartment 140 located below the bottom sump portion 142 of the tub 104, as generally recognized in the art. Each spray-arm assembly 144, 148 includes an arrangement of discharge ports or orifices for directing washing liquid onto dishes or other articles located in rack assemblies 130 and 132. The arrangement of the discharge ports in spray-arm assemblies 144, 148 provides a rotational force by virtue of washing fluid flowing through the discharge ports. The resultant rotation of the lower spray-arm assembly 144 provides coverage of dishes and other dishwasher contents with a washing spray.

The dishwasher 100 is further equipped with a controller 137 to regulate operation of the dishwasher 100. The controller may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor.

The controller 137 may be positioned in a variety of locations throughout dishwasher 100. In the illustrated embodiment, the controller 137 may be located within a control panel area 121 of door 120 as shown. In such an embodiment, input/output ("I/O") signals may be routed between the control system and various operational components of dishwasher 100 along wiring harnesses that may be routed through the bottom 122 of door 120. Typically, the controller 137 includes a user interface panel 136 through which a user may select various operational features and modes and monitor progress of the dishwasher 100. In one embodiment, the user interface 136 may represent a general purpose I/O ("GPIO") device or functional block. In one embodiment, the user interface 136 may include input components, such as one or more of a variety of electrical, mechanical or electromechanical input devices including rotary dials, push buttons, and touch pads. The user interface 136 may include a display component, such as a digital or analog display device designed to provide operational feedback to a user. The user interface 136 may be in communication with the controller 137 via one or more signal lines or shared communication busses.

It should be appreciated that the subject matter disclosed herein is not limited to any particular style, model, or other configuration of dishwasher, and that the embodiment depicted in FIGS. 1 and 2 is for illustrative purposes only. For example, instead of the racks 130, 132 depicted in FIG. 1, the dishwasher 100 may be of a known configuration that utilizes drawers that pull out from the cabinet and are accessible from the top for loading and unloading of articles. Also, the dishwasher 100 may not include an external cabinet and may, instead, include a wash chamber or tub mounted to a chassis that is not provided with external cabinetry other than the door. Other configurations may be used as well. In addition, it should be understood that the subject matter disclosed herein is not limited to dishwasher appliances and may be utilized in, e.g., trash compactor appliances, oven appliances, or any other suitable appliance.

Figure 3:
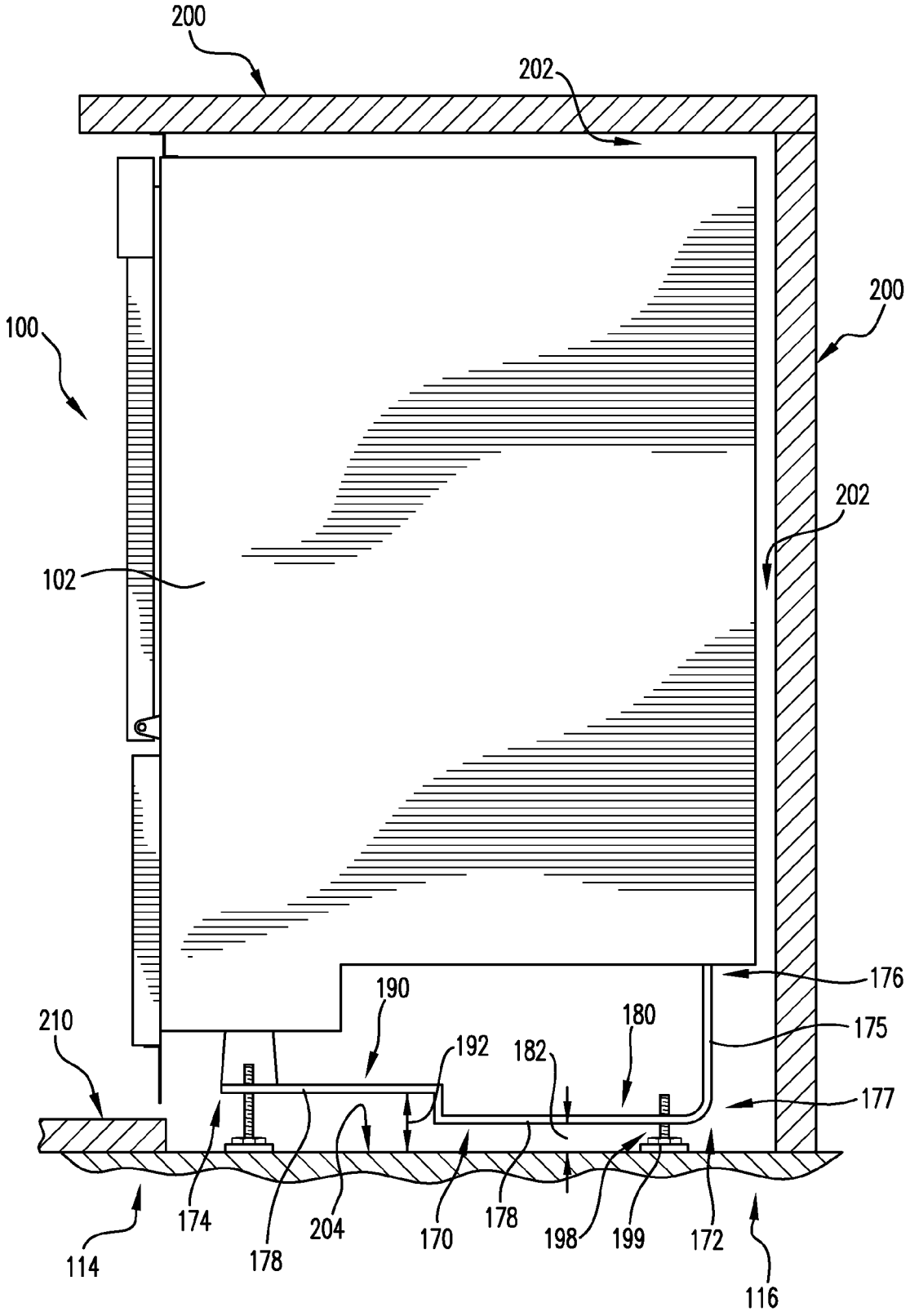
FIG. 3 illustrates a side view of the dishwasher appliance of FIG. 1, particularly illustrating an exemplary base element supporting a cabinet of the dishwasher appliance.

FIG. 3 illustrates a side view of the dishwasher appliance of FIG. 1. In FIG. 3, the dishwasher appliance 100 is disposed within a cavity 202 defined by a countertop enclosure 200. As discussed above, cabinet 102 is supported by base element 170. In FIGS. 2 and 3, base element 170 is a rail. However, as will be understood by those skilled in the art, base element 170 may also be formed by (e.g., defined by) bottom 112 of cabinet 102 or tub 104, may be a plate or sheet forming part of a chassis or frame of the appliance, or may have any other suitable construction that supports the appliance and makes contact with the floor surface.

Base element 170 extends between a first end 172 and a second end 174 and includes a projected portion 180 and an inset portion 190. Projected portion 180 is positioned adjacent back 116 of cabinet 102, and inset portion 190 is positioned adjacent front 114 of cabinet 102. First end 172 of base element 170 is positioned adjacent back 116 of cabinet 102, and second end 174 of base element 170 is positioned adjacent front 114 of cabinet 102.

Base element 170 includes a leg 175 that projects from bottom portion 112 of cabinet 102 towards floor 204 of countertop enclosure 200. Leg 175 extends between a proximal end 176 and a distal end 177. Proximal end 176 of leg 175 is positioned adjacent cabinet 102 (e.g., bottom 112 of cabinet 102).

In projected portion 180, base element 170 also includes an elongated member 178 positioned adjacent floor 204 of cabinet enclosure 200. Elongated member 178 extends longitudinally from distal end 177 of leg 175 towards front 114 of cabinet 102. Base element 170 may be constructed of a single continuous strap of metal. Thus, leg 175 and elongated member 178 may be constructed of a single continuous strap of metal. Other constructions may be used as well.

As may be seen in FIG. 3, inset portion 190 is further from floor 204 of countertop enclosure 200 and closer to cabinet 102 than projected portion 180. Thus, projected portion 180 is spaced apart from floor 204 by a first height 182, and inset portion 190 is spaced apart from floor 204 by a second height 192. As discussed in greater detail below, second height 192 is greater than first height 182. For example, a difference between first height 182 and second height 192 may be between about a quarter inch and about a half inch. In alternative embodiments, the difference between first height 182 and second height 192 may be any suitable length.

In addition, in FIG. 3, projected portion 180 and inset portion 190 are substantially parallel. However, in alternative embodiments, projected portion 180 and inset portion 190 need not be substantially parallel and may have any suitable configuration. Also, in FIG. 3, projected portion 180 includes about half of a length 171 (shown in FIG. 2) of base element 170. Thus, projected portion 180 may extend longitudinally about half of the length 171 of base element 170. However, in alternative embodiments, projected portion 180 may include more or less than about half of the length 171 of base element 170. Thus, projected portion 180 may extend longitudinally more or less than about half of the length 171 of base element 170.

Base element 170 also includes a plurality of feet 198 extending (e.g., downwardly) from base element 170. Plurality of feet 198 support base element 170. For example, in FIG. 3, tips 199 of plurality of feet 198 are resting on floor 204 of countertop enclosure 200 in order to support base element 170 and cabinet 102. Plurality of feet 198 may include screws that are received by base element 170 such that heights of each of the plurality of feet 198 may be adjusted in order to level cabinet 102. Thus, by rotating plurality of feet 198 clockwise or counterclockwise, the height of each of the plurality of feet 198 may be selectively adjusted.

FIG. 3 illustrates an installed configuration of dishwasher appliance 100. However, prior to installation, dishwasher appliance 100 is disposed outside of countertop enclosure 200. During installation of dishwasher appliance 100, cabinet 102 may slide across floor 204 of countertop enclosure 200 on base element 170 until cabinet 102 is properly disposed in countertop enclosure 200 as shown in FIG. 3. Water and drain hookups (not shown) within countertop enclosure 200 may be placed in fluid communication with dishwasher appliance 100 in order to provide water and/or fluid drainage for operating dishwasher appliance 100. However, as may be seen in FIG. 3, countertop enclosure 200 may provide a tight fit for dishwasher appliance. Accordingly, changes in the dimensions (e.g., height, width, and/or depth) of countertop enclosure 200 may result in dishwasher appliance 200 being unable to fit within countertop enclosure 200.

As may also be seen in FIG. 3, flooring 210 may be installed by a consumer adjacent the front 114 of cabinet 102. As an example, such flooring 210 may be hardwood flooring (e.g., one inch thick) installed after installation of dishwasher appliance 100 within countertop enclosure 200. As discussed above, due to tight tolerances within countertop enclosure 200, such flooring 210 may not be able to be installed on floor 204 of countertop enclosure 200. Thus, flooring 210 may terminate adjacent the front 114 of cabinet 102 rather than adjacent back 116 of cabinet 102.

After installation of flooring 210, dishwasher appliance 100 may be removed from countertop enclosure 200 by raising feet 198 at front 114 of cabinet 102 and sliding cabinet 102 across floor 204 of countertop enclosure 200 on base element 170. As cabinet 102 slides across floor 204 of countertop enclosure 200, inset portion 190 of base element 170 may receive flooring 210. By receiving the flooring 210, inset portion 190 permits dishwasher appliance 100 to slide on base element 170 until a portion of cabinet 102 is disposed outside of countertop enclosure 200. Thus, during removal, dishwasher appliance 100 may slide on base element 170 until flooring 210 approaches projected portion 180. However, as flooring 210 approaches projected portion 180, a sufficient portion of cabinet 102 will be positioned outside of countertop enclosure 200 to permit cabinet 102 to be removed from countertop enclosure 200. For example, in FIG. 3, when about half of cabinet 102 has cleared countertop enclosure 200, feet 198 at back 116 of cabinet 102 may be raised and cabinet 102 may be lifted in order to permit projected portion 180 of base element 170 to rest on flooring 210. When projected portion 180 is resting on flooring 210, cabinet 102 may be completely removed from countertop enclosure 200. Alternatively, when about half of cabinet 102 has cleared countertop enclosure 200, cabinet 102 may be rotated (e.g., tilted) away from countertop enclosure 200 such that the other half of cabinet 102 is removed (e.g., pulled) from countertop enclosure 200. A similar process, using a reverse order of steps, may be used to place dishwasher 100 back into enclosure 200.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An appliance comprising:

a cabinet having a top portion and a bottom portion;

a base rail positioned adjacent the bottom portion of said cabinet, said base rail extending downwardly from said cabinet in order to support said cabinet, said base rail extending from a first end to a second end, the second end of said base rail positioned adjacent a back of said cabinet and the first end of said base rail positioned adjacent a front of said cabinet, said base rail formed of a single continuous metal strap, said base rail comprising:

a projected portion positioned adjacent the second end of said base rail, said projected portion having a first height; and an inset portion positioned adjacent the first end of said base rail, said inset portion having a second height, the second height being greater than the first height.

2. The appliance of claim 1, wherein said cabinet defines a wash chamber, and said appliance is a dishwasher appliance, the dishwasher appliance further comprising:

a rack assembly slidably received into the wash chamber and configured for receipt of articles for cleaning; and a spray arm assembly for applying a fluid to the articles in said rack assembly.

3. The appliance of claim 1, wherein a difference between the first height and the second height is between about a quarter inch and about a half inch.

4. The appliance of claim 1, further comprising a plurality of feet extending from said base rail and configured for supporting said cabinet, said plurality of feet also configured for selective leveling of said cabinet.

5. The appliance of claim 4, wherein a first one of said plurality of feet is mounted to said base rail as said projected portion and a second one of said plurality of feet is mounted to said base rail at said inset portion.

6. The appliance of claim 1, wherein said projected portion and said inset portion are substantially horizontally oriented.

7. The appliance of claim 1, wherein said projected portion comprises more than about half of a length of said base rail.

8. The appliance of claim 1, wherein said projected portion comprises less than about half of a length of said base rail.

9. An appliance comprising:

a cabinet having a bottom portion and a top portion;

a base element positioned adjacent the bottom portion of said cabinet and configured for supporting said cabinet, said base element comprising:

a leg projecting downwardly from said cabinet and positioned adjacent a back of said cabinet, said leg having a proximal end and a distal end, the proximal end positioned adjacent said cabinet; and an elongated rail extending from the distal end of said leg towards a front of said cabinet, said elongated rail having an inset portion positioned adjacent the front of said cabinet and a projected portion positioned adjacent the back of said cabinet, the inset portion being positioned closer to said cabinet than said projected portion, the inset and projected portions of the elongated rail are formed of a single continuos metal band.

10. The appliance of claim 9, wherein said cabinet defines a wash chamber, and said appliance is a dishwasher appliance, the dishwasher appliance further comprising:

a rack assembly slidably received into the wash chamber and configured for receipt of articles for cleaning; and a spray arm assembly for applying a fluid to the articles in said rack assembly.

11. The appliance of claim 9, further comprising a plurality of feet extending from said base element and configured for supporting said cabinet, said plurality of feet also configured for selective leveling of said cabinet.

12. The appliance of claim 11, wherein a first one of said plurality of feet is mounted to said elongated rail at the projected portion of said elongated rail and a second one of said plurality of feet is mounted to said elongated rail at the inset portion of said elongated rail.

13. The appliance of claim 9, wherein said inset portion is between about a quarter inch and about a half inch closer to said cabinet than said projected portion.

14. The appliance of claim 9, wherein the inset portion extends longitudinally more than about half of a length of said elongated rail.

15. The appliance of claim 9, wherein the inset portion extends longitudinally less than about half of a length of said elongated rail.

16. The appliance of claim 9, wherein the projected portion and the inset portion are substantially horizontally oriented.

* * * * *